US011508311B2

(12) United States Patent
Wai et al.

(10) Patent No.: US 11,508,311 B2
(45) Date of Patent: Nov. 22, 2022

(54) DISPLAY DRIVER CIRCUIT, DISPLAY MODULE, METHOD FOR DRIVING DISPLAY, AND ELECTRONIC DEVICE

(71) Applicant: Huawei Technologies Co., Ltd., Shenzhen (CN)

(72) Inventors: Dustin Yuk Lun Wai, Shenzhen (CN); Chun Yen Liu, Dongguan (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/433,201

(22) PCT Filed: Feb. 18, 2020

(86) PCT No.: PCT/CN2020/075721
§ 371 (c)(1),
(2) Date: Aug. 23, 2021

(87) PCT Pub. No.: WO2020/169027
PCT Pub. Date: Aug. 27, 2020

(65) Prior Publication Data

US 2022/0122543 A1 Apr. 21, 2022

(30) Foreign Application Priority Data

Feb. 23, 2019 (WO) ..... PCT/CN2019/075981
Sep. 6, 2019 (CN) ..... 201910844205.0

(51) Int. Cl.
*G09G 3/3266* (2016.01)

(52) U.S. Cl.
CPC ... *G09G 3/3266* (2013.01); *G09G 2300/0408* (2013.01); *G09G 2300/0828* (2013.01);
(Continued)

(58) Field of Classification Search
CPC ..... G09G 2310/0286; G09G 2310/08; G09G 3/3677
See application file for complete search history.

(56) References Cited

U.S. PATENT DOCUMENTS 5,107,255 A 4/1992 Shiraishi
9,767,766 B2 9/2017 Oh et al.
(Continued)

FOREIGN PATENT DOCUMENTS

CN 201681587 U 12/2010
CN 102129831 A 7/2011
(Continued)

*Primary Examiner* — Van N Chow
(74) *Attorney, Agent, or Firm* — Conley Rose, P.C.

(57) ABSTRACT

An electronic device includes a display including a first display area and a second display area. The electronic device further includes a main controller configured to send a first clock signal separately to a first display driver circuit and a second display driver circuit. The first display driver circuit is configured to receive the first clock signal and to output a first GOA clock signal to the display. The first GOA clock signal is generated based on the first clock signal. The second display driver circuit is configured to receive the first clock signal, and is further configured to output a second GOA clock signal to the display. The second GOA clock signal is generated based on the first clock signal.

20 Claims, 12 Drawing Sheets

(52) U.S. Cl.
CPC ..... *G09G 2300/0842* (2013.01); *G09G 2310/0291* (2013.01); *G09G 2310/08* (2013.01)

(56) References Cited

U.S. PATENT DOCUMENTS

| | | | | |
|---|---|---|---|---|
| 2009/0189838 | A1* | 7/2009 | Chen | G09G 3/3614 345/87 |
| 2010/0253672 | A1 | 10/2010 | Ota | |
| 2017/0084228 | A1 | 3/2017 | Kwak | |
| 2018/0006099 | A1 | 1/2018 | Ka et al. | |
| 2018/0047759 | A1* | 2/2018 | Zhao | G11C 19/28 |
| 2018/0182278 | A1 | 6/2018 | Kim et al. | |
| 2020/0273409 | A1* | 8/2020 | Hsieh | G09G 3/3266 |

FOREIGN PATENT DOCUMENTS

| | | | |
|---|---|---|---|
| CN | 102143275 | A | 8/2011 |
| CN | 103247272 | A | 8/2013 |
| CN | 104536229 | A | 4/2015 |
| CN | 105118450 | A | 12/2015 |
| CN | 105741728 | A | 7/2016 |
| CN | 106898288 | A | 6/2017 |
| CN | 107633795 | A | 1/2018 |
| CN | 108257551 | A | 7/2018 |
| CN | 207781150 | U | 8/2018 |

* cited by examiner

DISPLAY DRIVER CIRCUIT, DISPLAY MODULE, METHOD FOR DRIVING DISPLAY, AND ELECTRONIC DEVICE

CROSS-REFERENCE TO RELATED APPLICATIONS

This application is a National Stage of International Patent Application No. PCT/CN2020/075721 filed on Feb. 18, 2020, which claims priority to Chinese Patent Application No. 201910844205.0 filed on Sep. 6, 2019 and International Patent Application No. PCT/CN2019/075981 filed on Feb. 23, 2019. All of the aforementioned applications are hereby incorporated by reference in their entireties.

TECHNICAL FIELD

This application relates to the field of terminal technologies, and in particular, to a display driver circuit, a display module, a method for driving a display, and an electronic device.

BACKGROUND

With rapid development of electronic technologies, electronic devices such as intelligent terminals and tablets have greatly changed the way people live and work. To meet various requirements of users for entertainment, office, video watching, web page browsing, or the like, an area of a display of an electronic device is designed to be increasingly large, which raises a higher performance requirement on a display driver circuit. Therefore, a capability of a single display driver circuit may be insufficient to drive a display panel. In this case, a display may be driven by using a plurality of display driver circuits, and such a driving structure may be referred to as a multi-display driver circuit system. In the multi-display driver circuit system, clock signals need to be synchronized between the plurality of display driver circuits to ensure that the display outputs normal video images.

In a synchronization method in the multi-display driver circuit system, the plurality of display driver circuits may include one main display driver circuit and at least one auxiliary display driver circuit. The main display driver circuit sends its internally generated clock signal to the auxiliary display driver circuit, and the auxiliary display driver circuit performs time synchronization based on the received clock signal, so as to implement synchronization between the plurality of display driver circuits. However, this synchronization manner is used only to synchronize a vertical synchronization (vertical synchronization, V-Sync) signal and a horizontal synchronization (horizontal synchronization, H-Sync) signal between the plurality of display driver circuits. The vertical synchronization signal is used to perform frame-to-frame synchronization for image scanning, and the horizontal synchronization signal is used to perform row-to-row synchronization for image scanning. A clock signal located in a row for scanning each row of pixels is generated based on an internal clock signal of each display driver circuit, and no clock synchronization is performed. An error exists between internal clock frequencies of different display driver circuits. Therefore, display performance of the display is affected.

SUMMARY

This application provides a display driver circuit, a display module, a method for driving a display, and an electronic device, which can improve display performance of a display.

According to a first aspect, an electronic device is provided, including: a display, including a first display area and a second display area; a main controller, including a first clock output end, where the first clock output end is configured to send a first clock signal separately to a first display driver circuit and a second display driver circuit; the first display driver circuit, including a first clock receive end, where the first clock receive end is configured to receive the first clock signal, where the first display driver circuit further includes a first gate driver on array GOA clock signal output end, the first GOA clock signal output end is configured to output a first GOA clock signal to the display, and the first GOA clock signal is used to control a GOA of the first display area to be enabled or disabled, where the first GOA clock signal is generated based on the first clock signal; and the second display driver circuit, including a second clock receive end, where the second clock receive end is configured to receive the first clock signal, where the second display driver circuit further includes a second GOA clock signal output end, the second GOA clock signal output end is configured to output a second GOA clock signal to the display, and the second GOA clock signal is used to control a GOA of the second display area to be enabled or disabled, where the second GOA clock signal is generated based on the first clock signal.

In this embodiment of this application, each of the plurality of display driver circuits in the electronic device can receive the first clock signal sent by the main controller, and generate a GOA clock signal based on the first clock signal. In this way, all the GOA clock signals output by the plurality of display driver circuits to the display are generated based on a same clock signal. This can reduce a frequency error between the GOA clock signals of the different display driver circuits, thereby improving display performance of the display.

With reference to the first aspect, in a possible implementation, the first display driver circuit further includes a first vertical synchronization signal output end, configured to output a first vertical synchronization signal to the display, where the first vertical synchronization signal is generated based on the first clock signal, and the first vertical synchronization signal is used to perform frame synchronization on the first display area; and the second display driver circuit further includes a second vertical synchronization signal output end, configured to output a second vertical synchronization signal to the display, where the second vertical synchronization clock signal is generated based on the first clock signal, the second vertical synchronization signal is used to perform frame synchronization on the second display area, and the first vertical synchronization signal and the second vertical synchronization signal are signals having a same phase.

In this embodiment of this application, each of the plurality of display driver circuits in the electronic device can receive the first clock signal sent by the main controller, and generate a vertical synchronization signal based on the first clock signal. In this way, the vertical synchronization signals output by the plurality of display driver circuits to the display are generated based on a same signal. This can reduce a frequency error between the vertical synchronization signals of the different display driver circuits, and reduce a timing error between the vertical synchronization signal and the GOA clock signal, thereby improving display performance of the display.

With reference to the first aspect, in a possible implementation, the first display driver circuit further includes a first horizontal synchronization signal output end, configured to output a first horizontal synchronization signal to the display, where the first horizontal synchronization signal is generated based on the first clock signal, and the first horizontal synchronization signal is used to perform row synchronization on the first display area; and the second display driver circuit further includes a second horizontal synchronization signal output end, configured to output a second horizontal synchronization signal to the display, where the second horizontal synchronization signal is generated based on the first clock signal, and the second horizontal synchronization signal is used to perform row synchronization on the second display area.

In this embodiment of this application, each of the plurality of display driver circuits in the electronic device can receive the first clock signal sent by the main controller, and generate a horizontal synchronization signal based on the first clock signal. In this way, the horizontal synchronization signals output by the plurality of display driver circuits to the display are generated based on a same clock signal. This can reduce a frequency error between the horizontal synchronization signals of the different display driver circuits, and reduce timing error between the horizontal synchronization signal and the GOA clock signal, thereby improving display performance of the display.

With reference to the first aspect, in a possible implementation, the first display driver circuit further includes a first emission EM signal output end, configured to output a first EM signal to the display, and the first EM signal is used to control a pixel circuit in the first display area to emit light or not to emit light, where the first EM signal is generated based on the first clock signal; and/or the second display driver circuit further includes a second EM signal output end, configured to output a second EM signal to the display, and the second EM signal is used to control a pixel circuit in the second display area to emit light or not to emit light, where the second EM signal is generated based on the first clock signal.

In this embodiment of this application, each of the plurality of display driver circuits in the electronic device can receive the first clock signal sent by the main controller, and generate an EM signal based on the first clock signal. In this way, the EM signals output by the plurality of display driver circuits to the display are generated based on a same clock signal. This can reduce a frequency error between the EM signals of the different display driver circuits, and reduce a timing error between the EM signal and the GOA clock signal, thereby improving display performance of the display.

With reference to the first aspect, in a possible implementation, the first display driver circuit includes a video processing module, the video processing module is configured to process video data input by the main controller, to generate a video source signal to be sent to the display, a reference clock of a digital circuit in the video processing module is a third clock signal generated by an internal clock generation module in the first display driver circuit, and a reference clock of an analog circuit in the video processing module is the first clock signal.

In this embodiment of this application, the display driver circuit uses the first clock signal sent by the main controller as the reference clock of the analog circuit in the display driver circuit, and uses the internally generated third clock signal as the reference clock of the digital circuit in the display driver circuit. This can reduce a frequency error between the clock signals of the plurality of display driver circuits, and reduce problems such as timing closure and electromagnetic interference.

With reference to the first aspect, in a possible implementation, a first buffer is disposed in the video processing module, and the first buffer is disposed between the digital circuit and the analog circuit in the video processing module.

According to a second aspect, a display driver circuit is provided, where the display driver circuit includes: a first clock receive end, configured to receive a first clock signal sent by a main controller; and a first gate driver on array GOA clock signal output end, where the first GOA clock signal output end is configured to output a first GOA clock signal to the display, and the first GOA clock signal is used to control a GOA of the display to be enabled or disabled, where the first GOA clock signal is generated based on the first clock signal.

It should be understood that, the display driver circuit in the second aspect and the electronic device in the first aspect are based on a same inventive concept. Therefore, for beneficial technical effects that can be achieved by the technical solution in the second aspect, refer to the description of the first aspect. Details are not described again.

With reference to the second aspect, in a possible implementation, the display driver circuit further includes a first vertical synchronization signal output end, configured to output a first vertical synchronization signal to the display, where the first vertical synchronization signal is generated based on the first clock signal, and the first vertical synchronization signal is used to perform frame synchronization on the display.

With reference to the second aspect, in a possible implementation, the display driver circuit further includes a first horizontal synchronization signal output end, configured to output a first horizontal synchronization signal to the display, where the first horizontal synchronization signal is generated based on the first clock signal, and the first horizontal synchronization signal is used to perform row synchronization on the display.

With reference to the second aspect, in a possible implementation, the first display driver circuit further includes a first emission EM signal output end, configured to output a first EM signal to the display, and the first EM signal is used to control a pixel circuit in the display to emit light or not to emit light, where the first EM signal is generated based on the first clock signal.

With reference to the second aspect, in a possible implementation, the display driver circuit includes a video processing module, the video processing module is configured to process video data input by the main controller, to generate a video source signal to be sent to the display, a reference clock of a digital circuit in the video processing module is a third clock signal generated by an internal clock generation module in the display driver circuit, and a reference clock of an analog circuit in the video processing module is the first clock signal.

With reference to the second aspect, in a possible implementation, a first buffer is disposed in the video processing module, and the first buffer is disposed between the digital circuit and the analog circuit in the video processing module.

According to a third aspect, a method for driving a display is provided, where the display includes a first display area and a second display area; and the method includes: a main controller sends a first clock signal separately to a first display driver circuit and a second display driver circuit; the first display driver circuit outputs a first gate driver on array GOA clock signal to the display, and the first GOA clock signal is used to control a GOA of the first display area to be enabled or disabled, where the first GOA clock signal is generated based on the first clock signal; and the second display driver circuit outputs a second GOA clock signal to the display, where the second GOA clock signal is used to control a GOA of the second display area to be enabled or disabled, and the second GOA clock signal is generated based on the first clock signal.

It should be understood that, the method for driving a display in the third aspect and the electronic device in the first aspect are based on a same inventive concept. Therefore, for beneficial technical effects that can be achieved by the technical solution in the third aspect, refer to the description of the first aspect. Details are not described again.

With reference to the third aspect, in a possible implementation, the method further includes: the first display driver circuit outputs a first vertical synchronization signal to the display, where the first vertical synchronization signal is generated based on the first clock signal, and the first vertical synchronization signal is used to perform frame synchronization on the first display area; and the second display driver circuit outputs a second vertical synchronization signal to the display, where the second vertical synchronization clock signal is generated based on the first clock signal, the second vertical synchronization signal is used to perform frame synchronization on the second display area, and the first vertical synchronization signal and the second vertical synchronization signal are signals having a same phase.

With reference to the third aspect, in a possible implementation, the first display driver circuit further includes a first horizontal synchronization signal output end, configured to output a first horizontal synchronization signal to the display, where the first horizontal synchronization signal is generated based on the first clock signal, and the first horizontal synchronization signal is used to perform row synchronization on the first display area; and the second display driver circuit further includes a second horizontal synchronization signal output end, configured to output a second horizontal synchronization signal to the display, where the second horizontal synchronization signal is generated based on the first clock signal, and the second horizontal synchronization signal is used to perform row synchronization on the second display area.

With reference to the third aspect, in a possible implementation, the first display driver circuit further includes a first emission EM signal output end, configured to output a first EM signal to the display, and the first EM signal is used to control a pixel circuit in the first display area to emit light or not to emit light, where the first EM signal is generated based on the first clock signal; and the second display driver circuit further includes a second EM signal output end, configured to output a second EM signal to the display, and the second EM signal is used to control a pixel circuit in the second display area to emit light or not to emit light, where the second EM signal is generated based on the first clock signal.

With reference to the third aspect, in a possible implementation, the first display driver circuit includes a video processing module, the video processing module is configured to process video data input by the main controller, to generate a video source signal to be sent to the display, a reference clock of a digital circuit in the video processing module is a third clock signal generated by an internal clock generation module in the first display driver circuit, and a reference clock of an analog circuit in the video processing module is the first clock signal.

With reference to the third aspect, in a possible implementation, a first buffer is disposed in the video processing module, and the first buffer is disposed between the digital circuit and the analog circuit in the video processing module.

According to a fourth aspect, a display module is provided, including: a display, including a first display area and a second display area; a first display driver circuit, including a first clock receive end, where the first clock receive end is configured to receive a first clock signal sent by a main controller, where the first display driver circuit further includes a first gate driver on array GOA clock signal output end, the first GOA clock signal output end is configured to output a first GOA clock signal to the display, and the first GOA clock signal is used to control a GOA of the first display area to be enabled or disabled, where the first GOA clock signal is generated based on the first clock signal; and a second display driver circuit, including a second clock receive end, where the second clock receive end is configured to receive the first clock signal, where the second display driver circuit further includes a second GOA clock signal output end, the second GOA clock signal output end is configured to output a second GOA clock signal to the display, and the second GOA clock signal is used to control a GOA of the second display area to be enabled or disabled, where the second GOA clock signal is generated based on the first clock signal.

It should be understood that, the display module in the fourth aspect and the electronic device in the first aspect are based on a same inventive concept. Therefore, for beneficial technical effects that can be achieved by the technical solution in the fourth aspect, refer to the description of the first aspect. Details are not described again.

With reference to the fourth aspect, in a possible implementation, the first display driver circuit further includes a first vertical synchronization signal output end, configured to output a first vertical synchronization signal to the display, where the first vertical synchronization signal is generated based on the first clock signal, and the first vertical synchronization signal is used to perform frame synchronization on the first display area; and the second display driver circuit further includes a second vertical synchronization signal output end, configured to output a second vertical synchronization signal to the display, where the second vertical synchronization clock signal is generated based on the first clock signal, the second vertical synchronization signal is used to perform frame synchronization on the second display area, and the first vertical synchronization signal and the second vertical synchronization signal are signals having a same phase.

With reference to the fourth aspect, in a possible implementation, the first display driver circuit further includes a first horizontal synchronization signal output end, configured to output a first horizontal synchronization signal to the display, where the first horizontal synchronization signal is generated based on the first clock signal, and the first horizontal synchronization signal is used to perform row synchronization on the first display area; and the second display driver circuit further includes a second horizontal synchronization signal output end, configured to output a second horizontal synchronization signal to the display, where the second horizontal synchronization signal is generated based on the first clock signal, and the second horizontal synchronization signal is used to perform row synchronization on the second display area.

With reference to the fourth aspect, in a possible implementation, the first display driver circuit further includes a first emission EM signal output end, configured to output a first EM signal to the display, and the first EM signal is used to control a pixel circuit in the first display area to emit light or not to emit light, where the first EM signal is generated based on the first clock signal; and the second display driver circuit further includes a second EM signal output end, the second EM signal output end is configured to output a second EM signal to the display, and the second EM signal is used to control a pixel circuit in the second display area to emit light or not to emit light, where the second EM signal is generated based on the first clock signal.

With reference to fourth aspect, in a possible implementation, the first display driver circuit includes a video processing module, the video processing module is configured to process video data input by the main controller, to generate a video source signal to be sent to the display, a reference clock of a digital circuit in the video processing module is a third clock signal generated by an internal clock generation module in the first display driver circuit, and a reference clock of an analog circuit in the video processing module is the first clock signal.

With reference to the fourth aspect, in a possible implementation, a first buffer is disposed in the video processing module, and the first buffer is disposed between the digital circuit and the analog circuit in the video processing module.

According to a fifth aspect, this application provides a circuit system, including a processor. The processor is configured to read and execute a computer program stored in a memory, to perform the method in the third aspect or any possible implementation of the third aspect, or perform the method in the fourth aspect or any possible implementation of the fourth aspect.

Optionally, the circuit further includes the memory, and the memory and the processor are connected to the memory by using a circuit or a wire.

Further, optionally, the circuit system further includes a communications interface.

According to a sixth aspect, this application provides a computer readable storage medium, where the computer readable storage medium stores computer instructions. When the computer instructions are run on a computer, the computer is enabled to perform the method in the third aspect or any possible implementation of the third aspect.

According to a seventh aspect, this application provides a computer program product, where the computer program product includes computer program code. When the computer program code is run on a computer, the computer is enabled to perform the method in the third aspect or any possible implementation of the third aspect.

DESCRIPTION OF EMBODIMENTS

The following describes the technical solution of this application with reference to the accompanying drawings.

Embodiments of this application provide a display driver circuit, a method for driving a multi-display driver circuit system, and an electronic device, which can improve display performance of a display. The display driver circuit may be disposed in the electronic device.

The electronic device in the embodiments of this application may include any electronic device including a display, such as user equipment, a mobile terminal, a mobile phone, or a tablet computer (pad). The embodiments of this application se no limitation thereto.

The electronic device in the embodiments of this application includes a multi-display driver system, and the multi-display driver system includes a plurality of display driver circuits. In the embodiments of this application, an example in which the multi-display driver system includes two display driver circuits is used for description. A person skilled in the art can understand that this application may also be applied to a multi-display driver circuit system including more than two display driver circuits.

Figure 1:
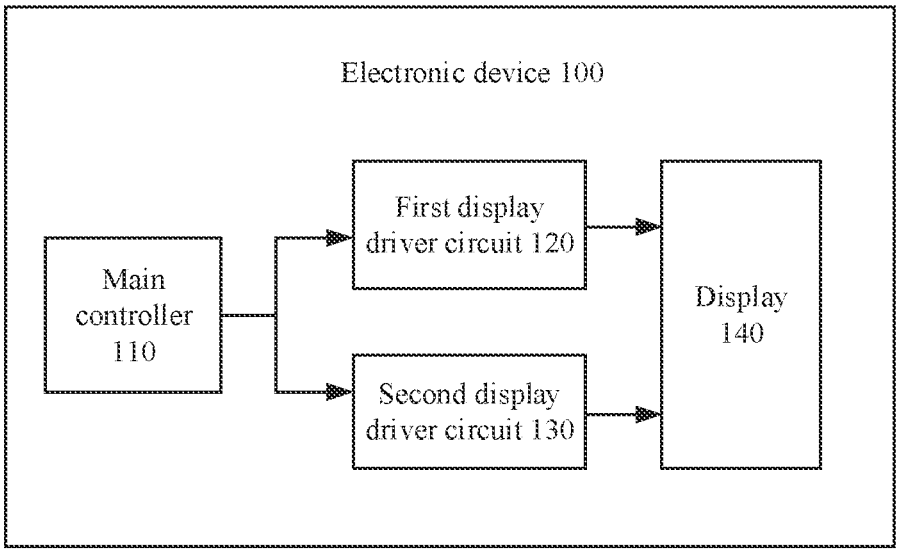
FIG. 1 is a schematic structural diagram of an electronic device according to an embodiment of this application.

FIG. 1 is a schematic structural diagram of an electronic device according to an embodiment of this application. The electronic device 100 is a multi-display driver circuit system. As shown in FIG. 1, the electronic device 100 includes a main controller 110, a first display driver circuit 120, a second display driver circuit 130, and a display 140. For ease of description, the following describes definitions of terms in FIG. 1.

The main controller 110 is configured to output to-be-processed video data, a clock synchronization signal, signaling, and the like to the display driver circuits (120, 130). The main controller may include but is not limited to various types of processors such as a system on chip (system on chip, SOC), an application processor (application processor, AP), or a general-purpose processor.

The display driver circuits (120, 130) are configured to receive the video data sent from the main controller 110, and obtain a video source signal after performing digital processing and analog processing on the video data. The video source signal is output to the display 130, so as to drive the display 130 to display an image. In addition, the display driver circuit 120 may further perform emission (emission, EM) control management, gate driver on array (gate driver on array, GOA) control management, and supply voltage management on the display 130, and output an emission (emission, EM) signal, an emission layer VDD (emission layer VDD, ELVDD) signal, an emission layer VSS (emission layer VSS, ELVSS) signal, a GOA clock signal, and the like to the display. In the embodiments of this application, the video source signal may also be referred to as a source signal.

Optionally, the plurality of display driver circuits may be connected to each other by using an interface, so as to perform clock synchronization or interaction. In some examples, a display driver circuit may also be referred to as a display driver integrated circuit (display driver integrated circuit, DDIC).

The display 140 is configured to receive the video source signal separately from the display driver circuit 120 and the display driver circuit 130, and display an image. The display may include a folded display, or may include a non-folded display. The display 140 may be implemented by using a flexible display or a rigid display. The flexible display may include, for example, a structure such as an organic light-emitting diode (organic light-emitting diode, OLED) display. The embodiments of this application set no limitation thereto.

Figure 2:
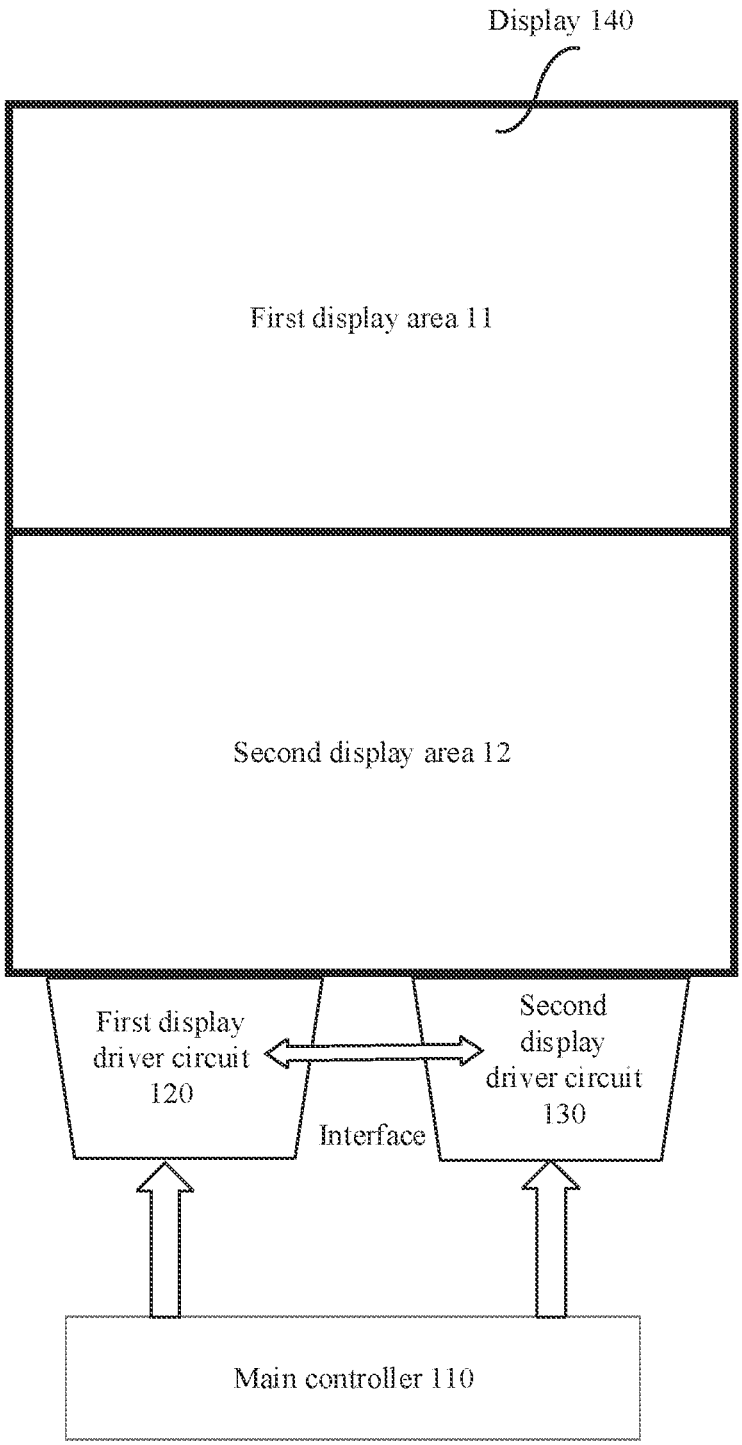
FIG. 2 is a schematic flowchart of processing video data by a multi-display driver circuit system according to an embodiment of this application.

FIG. 2 is a schematic flowchart of processing video data by a multi-display driver circuit system according to an embodiment of this application. As shown in FIG. 2, the display 140 may be divided into a first display area 11 and a second display area 12. The first display area 11 corresponds to the first display driver circuit 120, and the second display area 12 corresponds to the second display driver circuit 130. The different display driver circuits (120, 130) are configured to drive different display areas. Optionally, an interface may exist between the first display driver circuit 120 and the second display driver circuit 130, and clock synchronization or signaling interaction may be performed by using the interface.

The main controller 110 may divide the video data into a plurality of pieces of sub-video data based on the plurality of display areas, and send the sub-video data to the different display driver circuits respectively. After each of the plurality of display driver circuits processes the corresponding sub-video data, a plurality of sub-video source signals are obtained. The plurality of display driver circuits may respectively send the plurality of sub-video source signals to the display, so as to drive the different display areas of the display to display an image.

For ease of understanding the solutions of this application, the following describes structures and working principles of a pixel circuit and a GOA in the display in the embodiments of this application with reference to the accompanying drawings. It should be noted that the following description is merely used as an example of the pixel circuit, but is not intended to limit the protection scope of this application. Solutions or variations thereof obtained by a person skilled in the art based on the solutions of this application without creative efforts also fall within the protection scope of this application.

The pixel circuit is a minimum circuit unit in the display. One pixel circuit is equivalent to one sub pixel (or referred to as a sub-pixel) in the display, and the display includes a plurality of rows of sub pixels. Based on a structure of the pixel circuit, the sub pixels in the display are scanned row by row and emit light row by row. Therefore, when one frame of image is to be displayed, sub pixels in the first row emit light and need to keep emitting light until sub pixels in the last row emit light, so that the frame of image can be displayed. The GOA is configured to control a GOA of each row in the display to be enabled or disabled, so as to control input of a gating signal to each row of pixel circuits.

Figure 3:
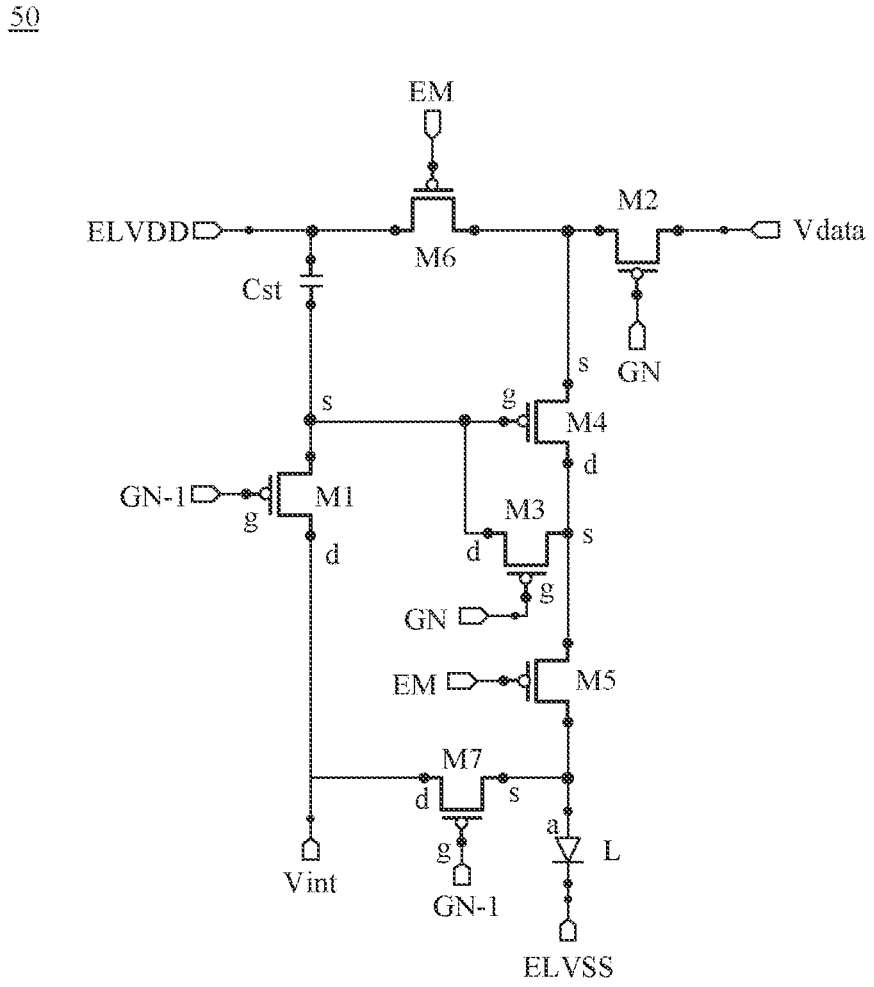
FIG. 3 is a schematic circuit diagram of a pixel circuit according to an embodiment of this application.

FIG. 3 is a schematic circuit diagram of a pixel circuit according to an embodiment of this application. As shown in FIG. 3, a pixel circuit 50 may include a capacitor Cst, a light-emitting device L, and a plurality of transistors (M1, M2, M3, M4, M5, M6, and M7). For ease of description, the transistor M1 is referred to as a first reset transistor, the transistor M7 is referred to as a second reset transistor, the transistor M4 is referred to as a driving transistor, the transistor M6 is referred to as a first emission control transistor, and the transistor M5 is referred to as a second emission control transistor. It should be noted that, this is merely an example of the pixel circuit, and the pixel circuit may alternatively use another design, for example, a 2T1C circuit including only two transistors and one capacitor, a 4T1C circuit including four transistors and one capacitor, and a 5T2C circuit including five transistors and two capacitors. In all of these pixel circuit designs, conduction and cutoff of a transistor connected in series to a light-emitting device may be controlled by using an EM signal, so as to control emission of the light-emitting device. This embodiment of this application sets no limitation thereto.

It should be noted that, the light-emitting device L may be an organic light-emitting diode (organic light emitting diode, OLED). In this case, the display is an OLED display. Alternatively, the light-emitting device L may be a micro light-emitting diode (micro light emitting diode, micro LED). In this case, the display is a micro LED display. For ease of description, the following provides a description by using an example in which the light-emitting device L is an OLED.

Figure 4:
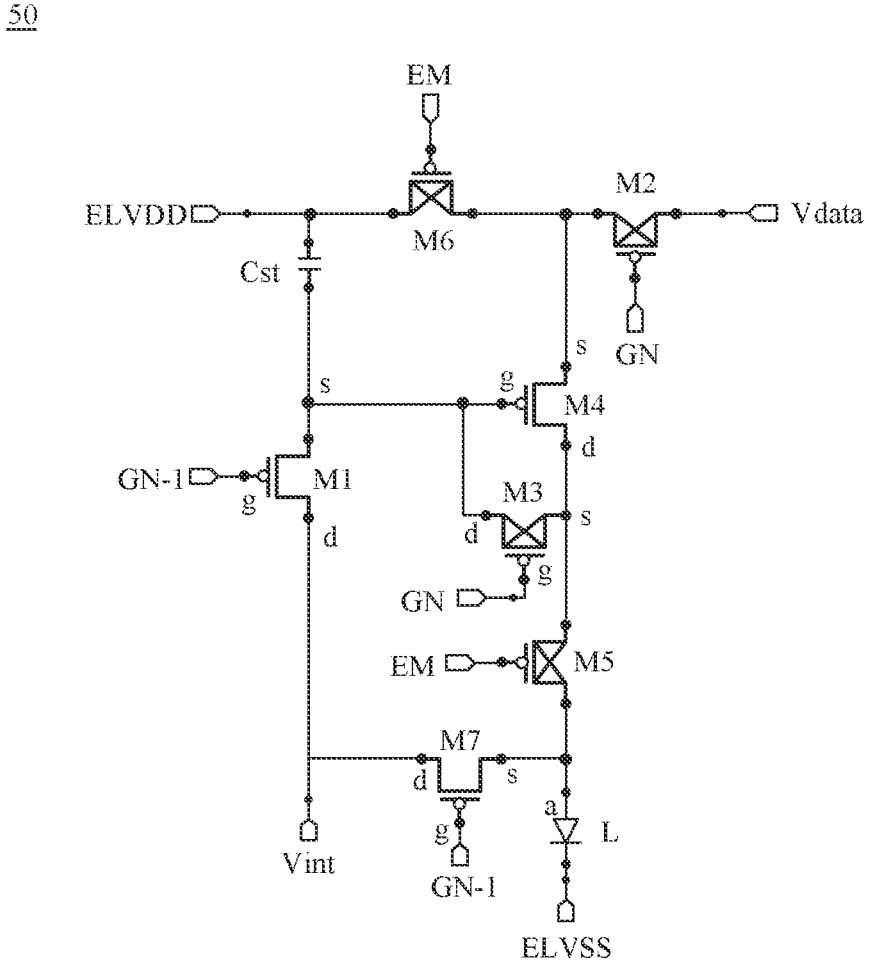
FIG. 4 is a schematic circuit diagram of a reset phase of a pixel circuit according to an embodiment of this application.
Figure 5:
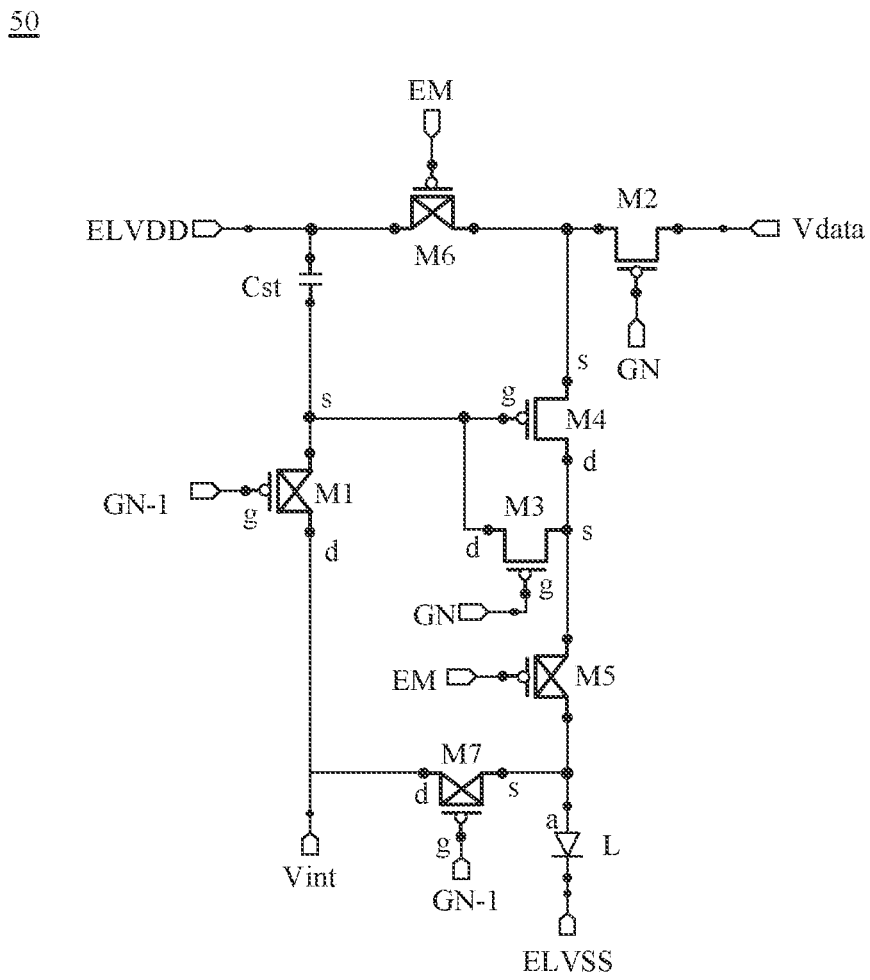
FIG. 5 is a schematic circuit diagram of a write phase of a data voltage Vdata of a pixel circuit according to an embodiment of this application.
Figure 6:
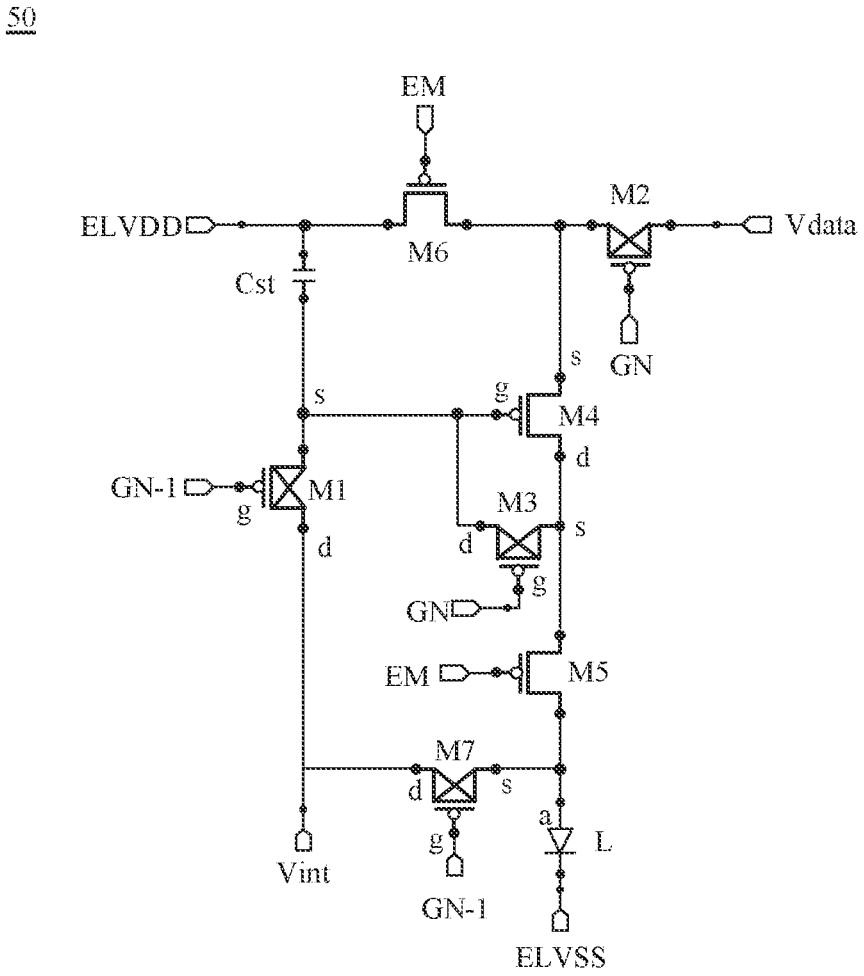
FIG. 6 is a schematic circuit diagram of an emission phase of a pixel circuit according to an embodiment of this application.

Based on a structure of the pixel circuit 50 shown in FIG. 3, a working process of the pixel circuit 50 includes three phases respectively shown in FIG. 4 to FIG. 6: a first phase ①, a second phase ②, and a third phase ③. In FIG. 4, FIG. 5, and FIG. 6, for ease of description, a transistor that is cut off is marked by a "x" sign for differentiation.

In the first phase ①, the first reset transistor M1 and the second reset transistor M7 are conducted under control of a gating signal GN-1, as shown in FIG. 4. An initial voltage Vint is transmitted to a gate of the driving transistor M4 through the first reset transistor M1, so as to reset the gate of the driving transistor M4. In addition, the initial voltage Vint is transmitted to an anode (anode, a) of the OLED through the second reset transistor M7, so as to reset the anode a of the OLED. In this case, a voltage Va of the anode a of the OLED and a voltage Vg4 of the gate g of the driving transistor M4 are Vint.

In this way, the voltages of the gate g of the driving transistor M4 and the anode a of the OLED may be reset to the initial voltage Vint in the first phase ①, thereby preventing residual voltages of a previous image frame that remain at the gate g of the driving transistor M4 and the anode a of the OLED from affecting a next image frame. Therefore, the first phase ① described above may be referred to as a reset phase.

In the second phase ②, the transistor M2 and the transistor M3 are conducted under control of a gating signal GN, as shown in FIG. 5. When the transistor M3 is conducted, the gate g of the driving transistor M4 is coupled to a drain (drain, d for short) of the driving transistor M4, and the driving transistor M4 is in a diode-conducted state. At this point, a data voltage Vdata is written to a source s of the driving transistor M4 through the conducted transistor M2.

Therefore, the second phase ② may be referred to as a data voltage Vdata writing phase of the pixel circuit.

In the third phase ③, the second emission control transistor M5 and the first emission control transistor M6 are conducted under control of an emission control signal EM, and a current path between a high supply voltage ELVDD and a low supply voltage ELVSS is conducted. A driving current I generated by the driving transistor M4 is transmitted to the OLED through the current path, so as to drive the OLED to emit light.

Because the OLED emits light in the third phase ③, the third phase ③ may be referred to as an emission phase. It can be learned from the description of the third phase ③ that, the EM signal can control the pixel circuit to stay in an emission state or a non-emission state.

Figure 7:
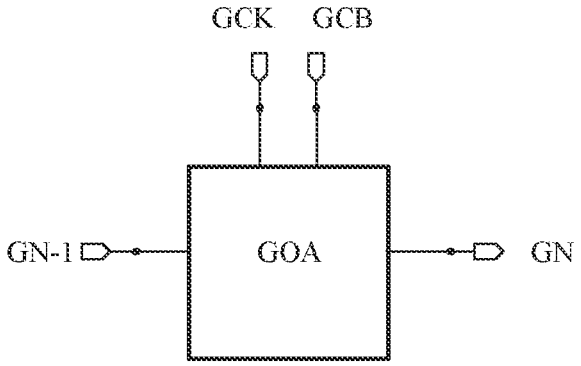
FIG. 7 is a schematic structural diagram of a gate driver on array (gate driver on array, GOA) according to an embodiment of this application.
Figure 8:
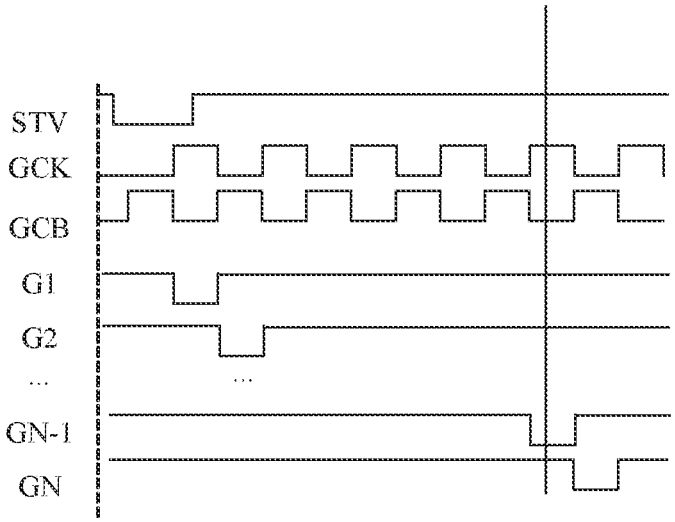
FIG. 8 is a schematic diagram of a time sequence of a GOA according to an embodiment of this application.

The following describes a working principle of a GOA circuit in the embodiments of this application with reference to FIG. 7 and FIG. 8. FIG. 7 is a schematic structural diagram of a GOA according to an embodiment of this application. FIG. 8 is a schematic diagram of a time sequence of a GOA circuit according to an embodiment of this application.

As shown in FIG. 7, the GOA includes a GCK clock input end and a GCB clock input end, which are configured to receive a GCK clock signal and a GCB clock signal, respectively. The GCK clock signal and the GCB clock signal are a pair of clock signals having opposite phases. A GOA management module in the display driver circuit may input the GCK clock signal and the GCB clock signal to the display. The GOA further includes a GN-1 signal input end, configured to receive a gating signal of a pixel circuit in a previous row of the display. The GOA further includes a GN signal output end, configured to output a gating signal of a pixel circuit in a current row corresponding to the GOA.

A G1 signal, a G2 signal, . . . , a GN-1 signal, and a GN signal in FIG. 8 respectively represent gating signals of pixel circuits in the first row to the $N^{th}$ row in the display. That is, the GN signal and the GN-1 signal are equivalent to the gating signals GN and GN-1 in FIG. 3 to FIG. 6. An STV signal represents a start signal. Under control of the GCK clock signal and the GCB clock signal, the STV signal starts the first row, and then the gating signals G1 and G2 sequentially control each row of pixel circuit to start refreshing. The GCK-controlled gating signals sequentially refresh each row of pixel circuit until all display areas in the display are scanned.

To enable the plurality of display areas in the display to display an image synchronously, clock synchronization is required between the plurality of display driver circuits in the multi-display driver system. In a clock synchronization solution, the plurality of display driver circuits may be divided into one main display driver circuit and at least one auxiliary display driver circuit. The main display driver circuit outputs a clock synchronization signal to the auxiliary display driver circuit, and the auxiliary display driver circuit performs clock synchronization on an internal circuit of the auxiliary display driver circuit based on the clock synchronization signal received from the main display driver circuit. For example, the clock synchronization signal may include a vertical synchronization (vertical synchronization, V-Sync) signal and a horizontal synchronization (horizontal synchronization, H-Sync) signal. The vertical synchronization signal is used to perform frame-to-frame synchronization for image scanning and the horizontal synchronization signal is used to perform row-to-row synchronization for image scanning. However, a clock signal located in a row for scanning each row of pixels is generated by an internal reference clock of each display driver circuit, and there is a frequency error between the internal clocks of the different display driver circuits. Therefore, display performance of the display is affected. For example, internal clocks of different display driver circuits may not have exactly identical frequencies due to differences in operating environments (for example, a temperature and humidity) and devices.

In the prior art, a gate driver on array (gate driver on array, GOA) clock signal is generated based on an internal reference clock signal of a display driver circuit. Therefore, there is a frequency error between GOA clock signals of different display driver circuits. The GOA clock signal is used to control the GOA of the display to be enabled or disabled. A GOA clock signal and a horizontal synchronization signal of the auxiliary display driver circuit are generated based on different reference clock signals. A GOA enabling time of a display area driven by the auxiliary display driver circuit is reduced in a row scanning time interval. As a result, a charging time of a pixel circuit in a row is insufficient, and performance of the display is affected. As an example, the GOA clock signal may include the GCK signal and the GCB signal in the example in FIG. 7 or FIG. 8.

To resolve the foregoing problem, embodiments of this application provide a solution for driving a multi-display driver system. In this solution, each of a plurality of display driver circuits receives a first clock signal sent by a main controller, and generates a GOA clock signal based on the first clock signal. Because all the GOA clock signals output by the plurality of display driver circuits are generated based on the first clock signal, a frequency error between the GOA clock signals output by the plurality of display driver circuits is reduced, and effective clock synchronization can be performed on the GOA clock signals of the plurality of display driver circuits, thereby improving display performance of the display.

Figure 9:
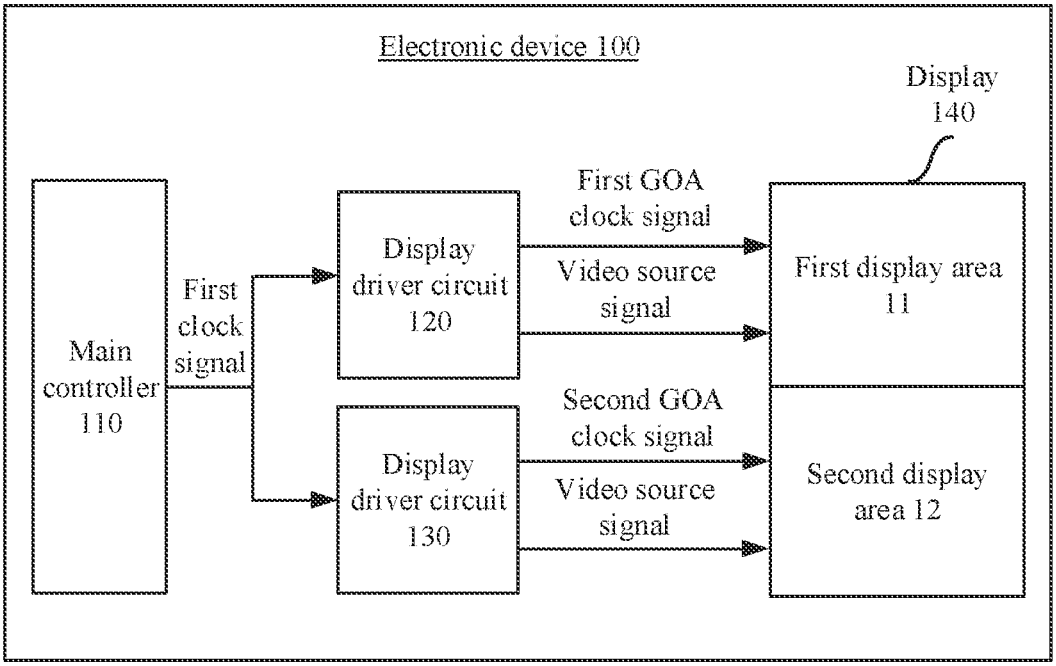
FIG. 9 is a schematic structural diagram of an electronic device according to an embodiment of this application.

FIG. 9 is a schematic diagram of an electronic device according to an embodiment of this application. As shown in FIG. 9, the electronic device includes a main controller 110, a display driver circuit 120, a display driver circuit 130, and a display 140. Functions of the foregoing modules are described below.

The display 140 includes a first display area 11 and a second display area 12.

The main controller 110 includes a first clock output end. The first clock output end is configured to send a first clock signal separately to the first display driver circuit and the second display driver circuit.

As an example, the first clock output end may be an MIPI TX interface of the main controller. The interface may output relatively high clock frequencies that are highly stable, such as frequencies from tens to hundreds of megahertz.

The first display driver circuit 120 includes a first clock receive end, and the first clock receive end is configured to receive the first clock signal. The first display driver circuit 120 further includes a first gate driver on array GOA clock signal output end, the first GOA clock signal output end is configured to output a first GOA clock signal to the display, and the first GOA clock signal is used to control a GOA of the first display area to be enabled or disabled, where the first GOA clock signal is generated based on the first clock signal.

The second display driver circuit 130 includes a second clock receive end, and the second clock receive end is configured to receive the first clock signal. The second display driver circuit 130 further includes a second GOA clock signal output end, the second GOA clock signal output end is configured to output a second GOA clock signal to the display, and the second GOA clock signal is used to control a GOA of the second display area to be enabled or disabled, where the second GOA clock signal is generated based on the first clock signal.

In an example of FIG. 7 or FIG. 8, the first GOA clock signal may be a GCK signal corresponding to the first display area, and the second GOA clock signal may be a GCK signal corresponding to the second display area. Alternatively, the first GOA clock signal may be a GCB signal corresponding to the first display area, and the second GOA clock signal may be a clock signal GCB signal corresponding to the second display area. The GCK signal and the GCB signal are a pair of clock signals having opposite phases.

Optionally, the first GOA clock signal and the second GOA clock signal may be signals having a same phase.

That the first GOA clock signal is generated based on the first clock signal may mean that the first GOA clock signal uses the first clock signal as a reference clock signal. In an example, frequency division processing or frequency multiplication processing may be performed on the first clock signal to obtain a second clock signal, and the first GOA clock signal may be generated based on the second clock signal. A case of the second GOA clock signal or another clock signal is similar. For brevity, details are not described herein again.

In this embodiment of this application, each of the plurality of display driver circuits in the electronic device can receive the first clock signal sent by the main controller, and generate a GOA clock signal based on the first clock signal. In this way, all the GOA clock signals output by the plurality of display driver circuits to the display are generated based on a same clock signal. This can reduce a frequency error between the GOA clock signals of the different display driver circuits, thereby improving display performance of the display.

Figure 10:
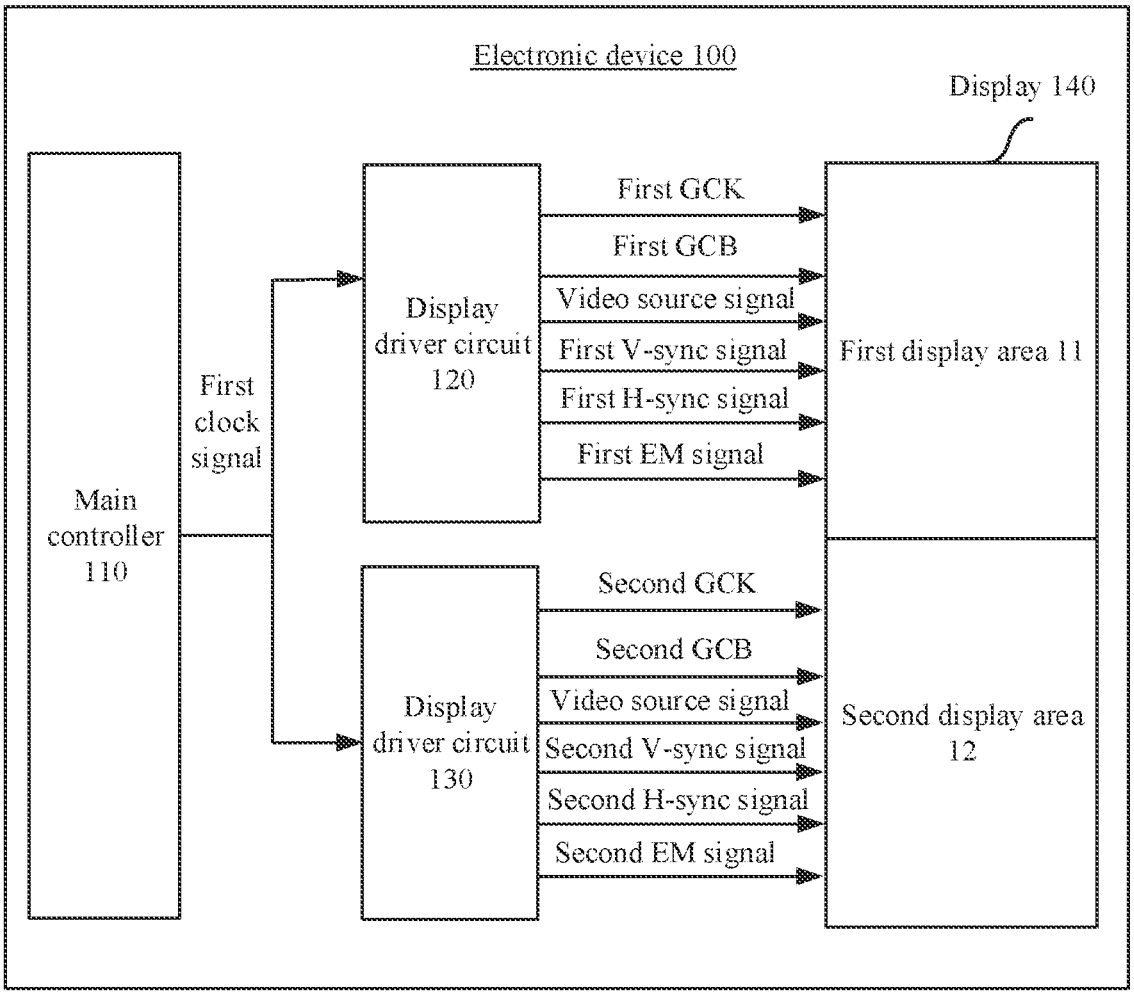
FIG. 10 is a schematic structural diagram of an electronic device according to another embodiment of this application.

As shown in FIG. 10, in an example, the first display driver circuit 120 includes a first GCK signal output end and a first GCB signal output end, which are configured to output a first GCK signal and a first GCB signal, respectively. The second display driver circuit 130 includes a second GCK signal output end and a second GCB signal output end. Phases of the first GCK, signal and the second GCK signal may be the same. Phases of the first GCB signal and the second GCB signal may be the same. The first GCK signal, the second GCK signal, the first GCB signal, and the second GCB signal are all generated based on the first clock signal. In other words, the first GOA clock signal output end in FIG. 9 includes the first GCK signal output end and/or the first GCB output end, and the second GOA clock signal output end in FIG. 9 includes the second GCK signal output end and/or the second GCB signal output end.

Optionally, each of the plurality of display driver circuits may further generate a vertical synchronization signal (namely, a V-sync signal) based on the first clock signal sent by the main controller. The vertical synchronization signal is used to perform frame-to-frame synchronization for image scanning. As an example, duration of each time frame may be 16.67 ms (milliseconds), in other words, a refresh rate of the display is 60 Hz (hertz). In this case, a frequency of V-sync is 60 Hz.

Still refer to FIG. 10. In an example, the first display driver circuit further includes a first vertical synchronization signal output end (or referred to as a first V-sync signal output end), and the first vertical synchronization signal output end is configured to output a first vertical synchronization signal (or referred to as a first V-sync signal). The first vertical synchronization signal is generated based on the first clock signal, and the first vertical synchronization signal is used to perform frame synchronization on the first display area. The second display driver circuit further includes a second vertical synchronization signal output terminal (or referred to as a second V-sync signal output end), and the second vertical synchronization signal end is configured to output a second vertical synchronization signal (or referred to as a second V-sync signal). The second vertical synchronization clock signal is generated based on the first clock signal, and the second vertical synchronization signal is used to perform frame synchronization on the second display area. Optionally, the first vertical synchronization signal and the second vertical synchronization signal are signals having a same phase.

In this embodiment of this application, each of the plurality of display driver circuits in the electronic device can receive the first clock signal sent by the main controller, and generate the vertical synchronization signal based on the first clock signal. In this way, the vertical synchronization signals output by the plurality of display driver circuits to the display are generated based on a same signal. This can reduce a frequency error between the vertical synchronization signals of the different display driver circuits, and reduce a timing error between the vertical synchronization signal and the GOA clock signal, thereby improving display performance of the display.

Optionally, each of the plurality of display driver circuits may further generate a horizontal synchronization signal based on the first clock signal sent by the main controller. The horizontal synchronization signal is used to perform row-to-row synchronization for image scanning. As an example, duration of each time frame may be 16.67 ms (milliseconds), in other words, a refresh rate of the display is 60 hertz. In this case, a frequency of V-sync is 60 Hz. A frequency of the horizontal synchronization signal is the refresh rate multiplied by a quantity of rows. For example, if the display has 2000 rows of pixels, the frequency of H-sync is 120 kHz (kilohertz).

Still refer to FIG. 10. In an example, the first display driver circuit further includes a first horizontal synchronization signal output end (or referred to as a first H-sync output end), and the first horizontal synchronization signal output end is configured to output a first horizontal synchronization signal (or referred to as a first H-sync signal). The first horizontal synchronization signal is generated based on the first clock signal, and the first horizontal synchronization signal is used to perform row synchronization on the first display area. The second display driver circuit further includes a second horizontal synchronization signal output end (or referred to as a second H-sync output end), and the second horizontal synchronization signal output end is configured to output a second horizontal synchronization signal (or referred to as a second H-sync signal). The second horizontal synchronization signal is generated based on the first clock signal, the second horizontal synchronization signal is used to perform row synchronization on the second display area, and the first horizontal synchronization signal and the second horizontal synchronization signal are signals having a same phase.

In this embodiment of this application, each of the plurality of display driver circuits in the electronic device can receive the first clock signal sent by the main controller, and generate the horizontal synchronization signal based on the first clock signal. In this way, the horizontal synchronization signals output by the plurality of display driver circuits to the display are generated based on a same clock signal. This can reduce a frequency error between the horizontal synchronization signals of the different display driver circuits, and reduce a timing error between the horizontal synchronization signal and the GOA clock signal, thereby improving display performance of the display.

As an example, a solution in the prior art may also be used for the vertical synchronization signals and the horizontal synchronization signals output by the display driver circuits. That is, the auxiliary display driver circuit generates a vertical synchronization signal and a horizontal synchronization signal based on a clock signal output by the main display driver circuit. In this solution, there are errors between the vertical synchronization signals (or the horizontal synchronization signals) and the GOA clock signals that are received by different display areas of the display. However, because the GOA clock signals received by the different display areas are synchronous, the time errors between the vertical synchronization signals (or the horizontal synchronization signals) and the GOA clock signals are fixed during a time interval of each frame (or each row) and do not accumulate with time. Therefore, impact on the display performance of the display is limited.

Still refer to FIG. 10. In an example, the first display driver circuit further includes a first EM signal output end, configured to output a first EM signal to the display, and the first EM signal is used to control a pixel circuit in the first display area to emit light or not to emit light, where the first EM signal is generated based on the first clock signal; and the second display driver circuit further includes a second EM signal output end, the second EM signal output end is configured to output a second EM signal to the display, and the second EM signal is used to control a pixel circuit in the second display area to emit light or not to emit light, where the second EM signal is generated based on the first clock signal.

In this embodiment of this application, each of the plurality of display driver circuits in the electronic device can receive the first clock signal sent by the main controller, and generate the EM signal based on the first clock signal. In this way, the EM signals output by the plurality of display driver circuits to the display are generated based on a same clock signal. This can reduce a frequency error between the EM signals of the different display driver circuits, and reduce a timing error between the EM signal and the GOA clock signal, thereby improving display performance of the display.

Figure 11:
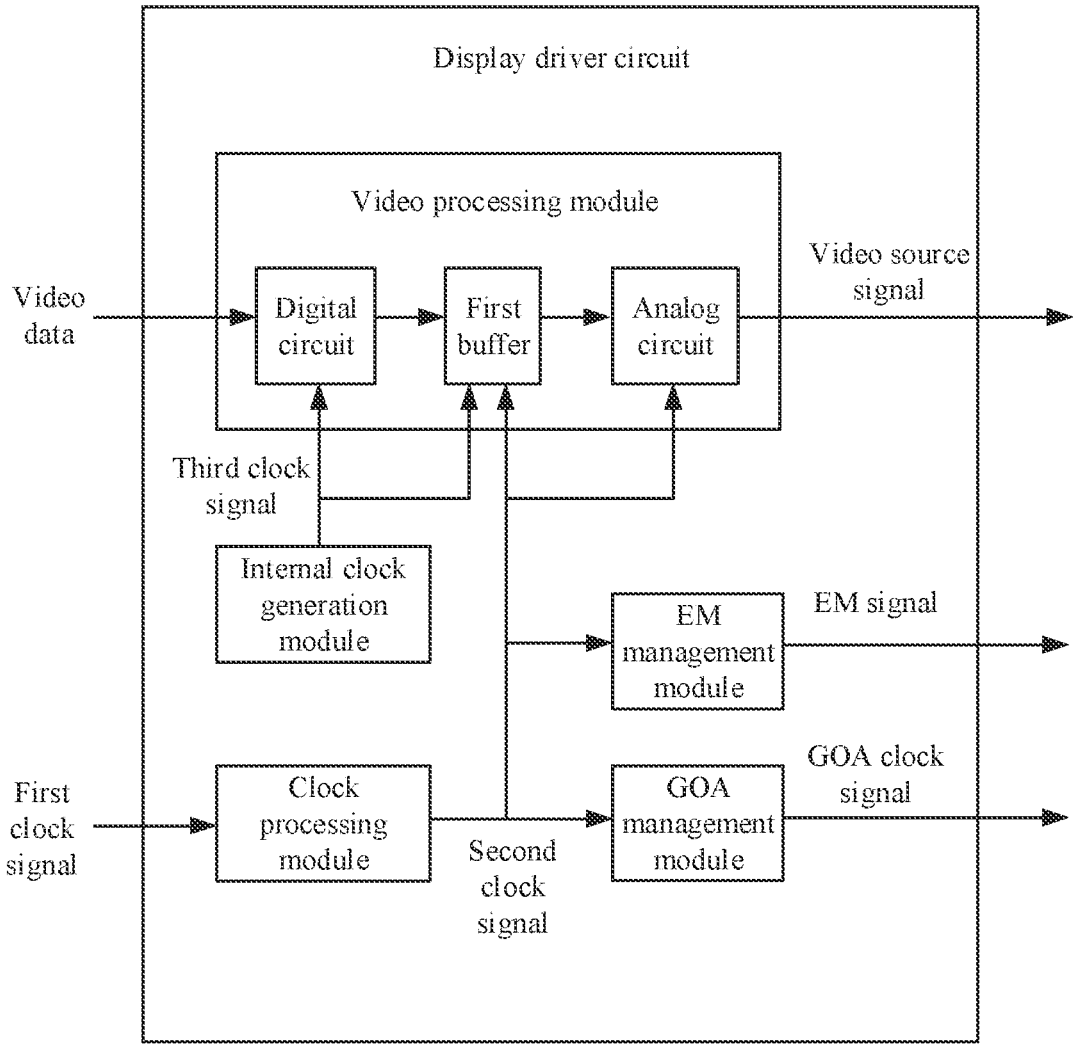
FIG. 11 is a schematic structural diagram of a display driver circuit according to an embodiment of this application.

FIG. 11 is a schematic structural diagram of a display driver circuit according to an embodiment of this application. The display driver circuit in FIG. 11 may be applied to the display driver circuit 120 and/or the display driver circuit 130 in FIG. 1, FIG. 2, FIG. 9, or FIG. 10. As shown in FIG. 10, the display driver circuit includes but is not limited to the following modules: a video processing module, a clock processing module, an internal clock generation module, a GOA management module, and an EM management module. It should be noted that, the structure in FIG. 11 is merely used as an example rather than a limitation, and the display driver circuit may include more or fewer functional modules than the foregoing modules. For example, the display driver circuit may further include a power management module and the like. Working principles of the modules and connection relationships between the modules may be extended or transformed based on actual application. This embodiment of this application sets no limitation thereto.

The video processing module is configured to receive video data sent by a main controller, and process the video data to generate a video source signal. The video processing module includes a digital circuit portion and an analog circuit portion, and the video data is successively processed by the digital circuit and the analog circuit.

Figure 12:
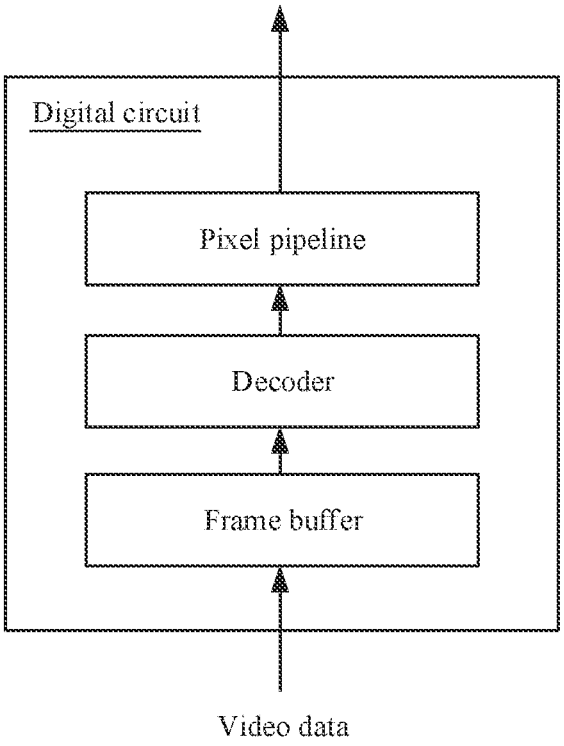
FIG. 12 is a schematic structural diagram of a digital circuit of a video processing module in a display driver circuit according to an embodiment of this application.

FIG. 12 is a schematic structural diagram of a digital circuit of a video processing module in a display driver circuit according to an embodiment of this application. As shown in FIG. 12, the digital circuit portion may include but is not limited to a frame buffer (frame buffers), a decoder (decoder), and a pixel pipeline (pixel pipeline). The pixel pipeline includes a plurality of digital modules for performing pipeline processing on pixel data, for example, a digital module for adjusting brightness. The video data may be successively processed by the frame buffer, the decoder, and the pixel pipeline.

Figure 13:
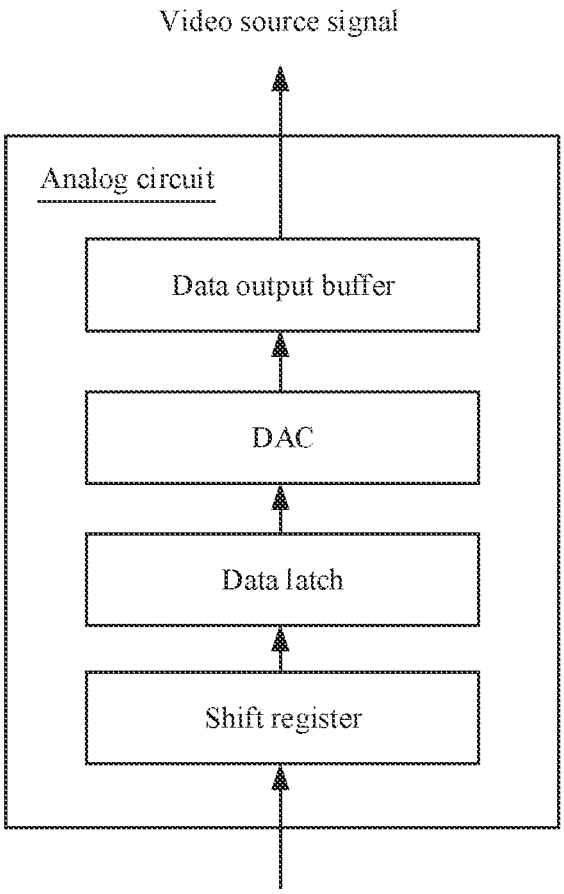
FIG. 13 is a schematic structural diagram of an analog circuit of a video processing module in a display driver circuit according to an embodiment of this application.

A video data stream obtained after processing by the digital circuit portion needs to be further processed by the analog circuit portion before being output to the display. FIG. 13 is a schematic structural diagram of an analog circuit of a video processing module in a display driver circuit according to an embodiment of this application. As shown in FIG. 13, the analog circuit portion includes but is not limited to modules such as a shift register (shifter register), a data latch, a digital-to-analog converter (digital to analog converter, DAC), and a data output buffer. A video data stream obtained after processing by the digital circuit may be sequentially processed by the modules such as the shift register, the data latch, the DAC, and the data output buffer, and then a video source signal is generated.

Still refer to FIG. 11. In an example, the clock processing module receives a first clock signal sent by the main controller, generates a second clock signal based on the first clock signal, outputs the second clock signal to the GOA management module, and uses the second clock signal as a reference clock signal of the GOA management module. The GOA management module generates a GOA clock signal based on the second clock signal, and the GOA clock signal may include the foregoing GCK signal and/or GCB signal.

In an example, the clock processing module may include a clock frequency division circuit. The first clock signal output by the main controller is usually a high-frequency signal. The display driver circuit needs to perform frequency division processing on the first clock signal to obtain a low-frequency second clock signal, and then use the second clock signal as a reference clock signal inside the display driver circuit.

Still refer to FIG. 11. In an example, the display driver circuit may further include an EM management module, the EM management module may generate an EM signal based on the second clock signal, and the EM signal is used to control a pixel circuit in a display to emit light or not to emit light.

In a possible solution, the display driver circuit may use the first clock signal as a primary reference clock signal inside the display driver circuit. For example, the first clock signal may be used as a clock signal of the digital circuit portion and the module circuit portion in the video processing module. However, because all clock signals in the display driver circuit are generated based on a same clock signal, a frequency range of the clock signals inside the display driver circuit is not flexibly adjustable, and therefore problems such as timing closure and electromagnetic interference (electro-magnetic interference, EMI) are brought to the display driver circuit.

To avoid the foregoing problems, in this embodiment of this application, the display driver circuit may use a third clock signal generated by the internal clock generation module as a reference clock signal of the digital circuit portion of the display driver circuit. The first clock signal may be used as a reference clock signal of the analog circuit portion, the EM management module, and/or the GOA management module of the display driver circuit.

Still refer to FIG. 11. In an example, the internal clock generation module is configured to generate a third clock signal, and the third clock signal may be used as a reference clock signal of a digital circuit portion of the video processing module, such as the frame buffer, the decoder, and the digital modules in the pixel pipeline. The third clock signal is a clock signal generated internally in the display driver circuit. In an example, the internal clock generation module includes an oscillator (oscillator, OSC).

Still refer to FIG. 11. In an example, the first clock signal may be used as a reference clock signal of the analog circuit portion of the video processing module. As an example, the clock processing module may perform frequency division processing on the first clock signal to obtain a second clock signal, and the second clock signal may be used as a reference signal of the analog circuit portion in the video processing module. For example, the second clock signal may be used to control the shift register and a module that follows the shift register and that belongs to the analog circuit.

Figure 14:
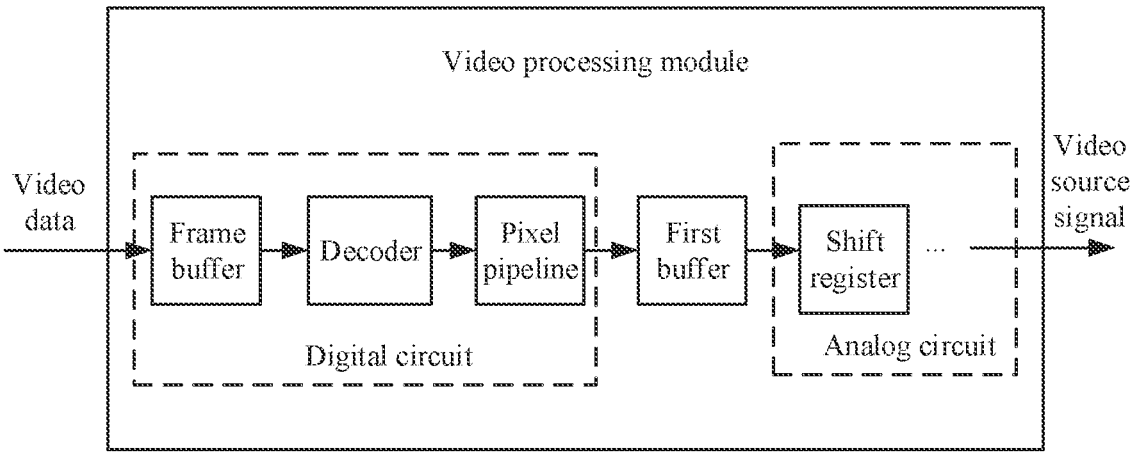
FIG. 14 is a schematic structural diagram of a video processing module according to an embodiment of this application.

As shown in FIG. 11, because the reference clock signal of the digital circuit and the reference clock for the following analog circuit are decoupled, a first buffer (buffer) may be added between the digital circuit portion and the analog circuit portion to compensate for a timing error that may be generated between different reference clocks. The first buffer may be configured to compensate for a latency caused by a difference between the reference clock signals of the digital circuit portion and the analog circuit portion. The first buffer receives the second clock signal and the third clock signal, and performs buffer processing on the input video data based on the clock signals to compensate for the timing error. FIG. 14 is a schematic diagram of a video processing module in a display driver circuit according to an embodiment of this application. As shown in FIG. 14, as an example, the buffer may be disposed between the pixel pipeline module of the digital circuit portion and the shift register of the analog circuit portion.

It should be noted that, in FIG. 11, before the second clock signal is input to each module in the video processing module, frequency division processing, frequency multiplication processing, or other types of processing may be further performed one or more times. This embodiment of this application is described by using the second clock signal as an example. Alternatively, in some examples, the display driver circuit does not need to perform frequency division processing, frequency multiplication processing, or other processing on the first clock signal, but may directly input the first clock signal to each module and use the first clock signal as a reference clock signal. In other words, the clock processing module in FIG. 11 is merely used as an example. Before the first clock signal is input to each module, processing may not be performed, or frequency division processing or frequency multiplication processing may be performed a plurality of times. In FIG. 11, the second clock signal may represent one or more clock signals, that is, the second clock signal input to each module may be a same signal with a same frequency, or may be a plurality of signals with different frequencies. The second clock signal is merely used as an example for description of a clock signal generated based on the first clock signal. Similarly, the third clock signal is merely used as an example illustration of a clock signal generated based on an internal clock signal of the display driver circuit.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solution. A person skilled in the art may use different methods to implement the described functions for each particular application, but it should not be considered that the implementation goes beyond the scope of this application.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in this application, it should be understood that the disclosed system, apparatus, and method may be implemented in other manners. For example, the described apparatus embodiments are merely examples. For example, the unit division is merely logical function division and may be other division in actual implementation. For example, a plurality of units or components may be combined or integrated into another system, or some features may be ignored or not performed. In addition, the displayed or discussed mutual couplings or direct couplings or communication connections may be implemented by using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected based on actual requirements to achieve the objectives of the solutions of the embodiments.

In addition, functional units in the embodiments of this application may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solution of this application essentially, or the part contributing to the prior art, or part of the technical solution may be implemented in a form of a software product. The software product is stored in a storage medium, and includes several instructions for instructing a computer device (which may be a personal computer, a server, or a network device) to perform all or some of the steps of the methods described in the embodiments of this application. The foregoing storage medium includes: any medium that can store program code, such as a USB flash drive, a removable hard disk, a read-only memory (read-only memory, ROM), a random access memory (random access memory, RAM), a magnetic disk, or an optical disc.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. An electronic device, comprising:

a display comprising a first display area and a second display area;

a first display driver circuit coupled to the display and comprising:

a first clock receive end; and a first gate driver on array (GOA) clock signal output end configured to output a first GOA clock signal to the display, wherein the first GOA clock signal is configured to control a GOA of the first display area to be enabled or disabled;

a second display driver circuit coupled to the display and comprising:

a second clock receive end; and a second GOA clock signal output end configured to output a second GOA clock signal to the display, wherein the second GOA clock signal is configured to control a GOA of the second display area to be enabled or disabled; and a main controller coupled to the first display driver circuit and the second display driver circuit and comprising a first clock output end configured to send a first clock signal separately to the first display driver circuit and the second display driver circuit, wherein the first clock receive end is configured to receive the first clock signal, wherein the first GOA clock signal is based on the first clock signal, wherein the second clock receive end is configured to receive the first clock signal, and wherein the second GOA clock signal is based on the first clock signal.

2. The electronic device of claim 1, wherein the first display driver circuit further comprises a first vertical synchronization signal output end configured to output a first vertical synchronization signal to the display to perform frame synchronization on the first display area, wherein the first vertical synchronization signal is based on the first clock signal, wherein the second display driver circuit further comprises a second vertical synchronization signal output end configured to output a second vertical synchronization signal to the display to perform frame synchronization on the second display area, wherein the second vertical synchronization signal is based on the first clock signal, and wherein the first vertical synchronization signal and the second vertical synchronization signal have a same phase.

3. The electronic device of claim 1, wherein the first display driver circuit further comprises a first horizontal synchronization signal output end configured to output a first horizontal synchronization signal to the display to perform row synchronization on the first display area, wherein the first horizontal synchronization signal is based on the first clock signal, wherein the second display driver circuit further comprises a second horizontal synchronization signal output end configured to output a second horizontal synchronization signal to the display to perform row synchronization on the second display area, and wherein the second horizontal synchronization signal is based on the first clock signal.

4. The electronic device of claim 1, wherein the first display driver circuit further comprises a first emission (EM) signal output end configured to output a first EM signal to the display to control a pixel circuit in the first display area to emit light or not to emit light, wherein the first EM signal is based on the first clock signal, wherein the second display driver circuit further comprises a second EM signal output end configured to output a second EM signal to the display to control a pixel circuit in the second display area to emit light or not to emit light, and wherein the second EM signal is based on the first clock signal.

5. The electronic device of claim 1, wherein the first display driver circuit further comprises:

an internal clock generation module configured to generate a second clock signal; and a video processing module that comprises a digital circuit and an analog circuit and is configured to process video data from the main controller to generate a video source signal to be sent to the display, wherein a first reference clock of the digital circuit is based on the second clock signal, and wherein a second reference clock of the analog circuit is based on the first clock signal.

6. The electronic device of claim 5, wherein the video processing module further comprises a buffer disposed between the digital circuit and the analog circuit in the video processing module.

7. The electronic device of claim 6, wherein the buffer is configured to compensate for a timing error between the first reference clock and the second reference clock.

8. The electronic device of claim 1, wherein the display comprises a flexible display.

9. A display driver circuit, comprising:

a first clock receive end configured to receive a first clock signal from a main controller;

a first gate driver on array (GOA) clock signal output end configured to output a first GOA clock signal to a display to control a GOA of the display to be enabled or disabled, wherein the first GOA clock signal is based on the first clock signal;

an internal clock generation module configured to generate a second clock signal; and a video processing module comprising a digital circuit and an analog circuit and configured to process video data from the main controller to generate a video source signal to be sent to the display, wherein a first reference clock of the digital circuit is based on the second clock signal, and wherein a second reference clock of the analog circuit is based on the first clock signal.

10. The display driver circuit of claim 9, wherein the display driver circuit further comprises a first vertical synchronization signal output end configured to output a first vertical synchronization signal to the display to perform frame synchronization on the display, and wherein the first vertical synchronization signal is based on the first clock signal.

11. The display driver circuit of claim 9, wherein the display driver circuit further comprises a first horizontal synchronization signal output end configured to output a first horizontal synchronization signal to the display to perform row synchronization on the display, and wherein the first horizontal synchronization signal is based on the first clock signal.

12. The display driver circuit of claim 9, wherein the display driver circuit further comprises a first emission (EM) signal output end configured to output a first EM signal to the display to control a pixel circuit in the display to emit light or not to emit light, and wherein the first EM signal is based on the first clock signal.

13. The display driver circuit of claim 9, wherein the video processing module further comprises a buffer disposed between the digital circuit and the analog circuit.

14. The display driver circuit of claim 13, wherein the buffer is configured to compensate for a timing error between the first reference clock and the second reference clock.

15. A method for driving a display of an electronic device, wherein the method comprises:

sending, by a main controller, a first clock signal separately to a first display driver circuit of the electronic device and a second display driver circuit of the electronic device;

outputting, by the first display driver circuit, a first gate driver on array (GOA) clock signal to the display to control a GOA of a first display area of the display to be enabled or disabled, wherein the first GOA clock signal is based on the first clock signal; and outputting, by the second display driver circuit, a second GOA clock signal to the display to control a GOA of a second display area of the display to be enabled or disabled, wherein the second GOA clock signal is based on the first clock signal.

16. The method of claim 15, further comprising:

outputting, by the first display driver circuit, a first vertical synchronization signal to the display to perform frame synchronization on the first display area, wherein the first vertical synchronization signal is based on the first clock signal; and outputting, by the second display driver circuit, a second vertical synchronization signal to the display to perform frame synchronization on the second display area, wherein the second vertical synchronization signal is based on the first clock signal, and wherein the first vertical synchronization signal and the second vertical synchronization signal have a same phase.

17. The method of claim 15, further comprising:

outputting, by a first horizontal synchronization signal output end of the first display driver circuit, a first horizontal synchronization signal to the display to perform row synchronization on the first display area, wherein the first horizontal synchronization signal is based on the first clock signal; and outputting, by a second horizontal synchronization signal output end of the second display driver circuit, a second horizontal synchronization signal to the display to perform row synchronization on the second display area, wherein the second horizontal synchronization signal is based on the first clock signal.

18. The method of claim 15, further comprising:

outputting, by a first emission (EM) signal output end of the first display driver circuit, a first EM signal to the display to control a pixel circuit in the first display area to emit light or not to emit light, wherein the first EM signal is based on the first clock signal; and outputting, by a second EM signal output end of the second display driver circuit, a second EM signal to the display to control a pixel circuit in the second display area to emit light or not to emit light, wherein the second EM signal is based on the first clock signal.

19. The method of claim 15, further comprising:

generating, by an internal clock generation module in the first display driver circuit, a third clock signal; and processing, by a video processing module of the first display driver circuit, video data input from the main controller to generate a video source signal to be sent to the display, wherein a first reference clock of a digital circuit in the video processing module is based on the third clock signal, and wherein a second reference clock of an analog circuit in the video processing module is based on the first clock signal.

20. The method of claim 19, further comprising compensating, by a buffer disposed in the video processing module between the digital circuit and the analog circuit, for a timing error between the first reference clock and the second reference clock.

* * * * *